United States Patent [19]

Wodlinger

[11] Patent Number: 4,763,870

[45] Date of Patent: Aug. 16, 1988

[54] TRAFFIC SIGNAL HEAD

[75] Inventor: Harold M. Wodlinger, Toronto, Canada

[73] Assignee: Fortran Traffic Systems Limited

[21] Appl. No.: 64,202

[22] Filed: Jun. 16, 1987

[30] Foreign Application Priority Data

Feb. 11, 1987 [CA] Canada ..... 592478

[51] Int. Cl.[4] ..... E01F 9/00

[52] U.S. Cl. ..... 248/611; 248/291; 248/324; 403/225; 403/133; 340/119; 362/390

[58] Field of Search ..... 248/603, 604, 605, 610, 248/611, 613, 284, 288.3, 291, 324, 342; 362/390, 369, 287, 430; 340/119; 403/225, 226, 133; 40/602, 613

[56] References Cited

U.S. PATENT DOCUMENTS

| | | | |
|---|---|---|---|
| 372,334 | 11/1887 | Sawyer . | |
| 548,899 | 10/1895 | Wade . | |
| 580,806 | 4/1897 | Scranton . | |
| 901,284 | 10/1908 | Edmunds . | |
| 2,106,737 | 2/1938 | Haire . | |
| 2,193,272 | 3/1940 | Crossley | 248/291 |
| 2,646,958 | 7/1953 | Coykendall, Jr. | 248/611 |
| 2,724,770 | 11/1955 | Onksen . | |
| 2,896,972 | 7/1959 | Zavertnik | 248/342 |
| 2,925,458 | 2/1960 | Lester | 248/342 |
| 2,970,289 | 1/1961 | Loomis | 340/119 |
| 3,604,916 | 9/1971 | Adra . | |
| 3,639,752 | 2/1972 | Appleton | 248/342 |
| 3,891,175 | 6/1975 | Hawley . | |

FOREIGN PATENT DOCUMENTS

| | | | |
|---|---|---|---|
| 674657 | 11/1963 | Canada | 248/611 |
| 976522 | 10/1975 | Canada . | |
| 986277 | 3/1976 | Canada . | |
| 1015347 | 8/1977 | Canada . | |
| 1023328 | 12/1977 | Canada . | |
| 1060408 | 8/1979 | Canada . | |
| 1060864 | 8/1979 | Canada . | |
| 1109043 | 9/1981 | Canada . | |
| 1179816 | 12/1984 | Canada . | |
| 728933 | 4/1932 | France | 403/133 |
| 825024 | 11/1937 | France | 403/133 |
| 329843 | 6/1958 | Switzerland | 403/225 |

*Primary Examiner*—J. Franklin Foss
*Assistant Examiner*—Robert A. Olson
*Attorney, Agent, or Firm*—Riches, McKenzie & Herbert

[57] ABSTRACT

A traffic signal hanger is disclosured in which an elastomeric member is provided intermediate a traffic signal support arm and a traffic signal housing which elastomeric member provides advantagous damped pivoting of the signal housing relative to the support to accommodate wind forces.

12 Claims, 5 Drawing Sheets

TRAFFIC SIGNAL HEAD

SCOPE OF THE INVENTION

This invention relates to traffic signal hangers and more particularly to a novel joint for a traffic signal hanger permitting marginal, damped pivoting of a traffic signal housing.

BACKGROUND OF THE INVENTION

U.S. Pat. No. 3,891,175 to Hawley et al teaches a traffic signal hanger which is adjustable about two axis for vertical hanging of the traffic signal housing and permits damped pivoting of the traffic signal housing about one horizontal axis.

The device of Hawley has elements of the hanger hingedly coupled together about one axle member with opposed helical metal springs biasing the elements to a neutral position. With the device having specific axle and journalling elements, a passageway for wire is spaced above the axle and journalling elements increasing the relative size of the device. The Hawley device suffers from the disadvantage of requiring specific axle and journalling elements and being limited in the extent to which it can be made compact yet maintain internal passageways for electrical wire.

SUMMARY OF THE INVENTION

To a least partially overcome these disadvantages of the prior art, the present invention provides an improved, traffic signal hanger having a novel joint between members. The joint comprises a cavity in one member with an upper end of another member received in the cavity and with elastomeric members between the cavity and the upper end. The elastomeric members may serve both to journal the two members together for marginal relative pivoting and to dampen such pivoting.

An object of the present invention is to provide a novel joint for traffic signal hangers providing advantageous dampening of pivoting between members of the joint through the use of elastomeric materials.

Another object is to provide compact traffic signal hangers through the use of a novel joint between pivotally movable elements.

Another object is to provide a simplified joint for traffic signal hangers by utilizing elastomeric materials to both journal metal elements for marginal relative pivoting and dampen such pivoting.

Accordingly, in a first of its aspects, the present invention provides a traffic signal hanger comprising:

first means fixedly coupled to support arm, second means fixedly coupled to a traffic signal housing, joint means coupling the first means and second means together for marginal pivoting of the second means with respect to the first means about a first axis, the joint means comprising:

(a) a cavity about the axis defined by internal surfaces of one of the first and second means;

(b) an end portion on the other of the first and second means extending into the cavity, the end portion having a passageway-forming bore therethrough; and (c) resiliently-deformable, elastomeric means in the cavity between the external surfaces of the end portion and the internal surfaces, the elastomeric means extending longitudionally with respect to the axis between the internal surfaces and the external surfaces supporting the end portion in the cavity with the first axis passing through the bore and spacing the end portion radially with respect to the first axis from the internal surfaces, wherein marginal pivoting of the end portion and the one of the first and second means relative to each other about the first axis form a neutral position compresses segments of the elastomeric means therebetween resisting pivoting and biasing a return toward the neutral position.

In a second aspect, the present invention provides a traffic signal hanger comprising:

a first member carrying, at a first end, arm mounting means for mounting on a support arm rotatable about the axis of the arm with first lock means to lock the first member in a desired position on the arm with respect to the axis of the arm, first socket means defined within the first member at the second end thereof, a second member received in the first socket means rotatable therein about a second axis normal to the axis of the arm with second lock means to lock the second member in a desired position in the first socket means with respect to the second axis, second socket means defined within the second member by interior surfaces thereof, a third member having an upper end received in the second socket means, the third member extending from the upper end out of the second socket means to a lower end carrying means for mounting a traffic signal housing, the upper end having a passageway therethrough, elastomeric means in the second socket means between the interior surfaces and external surfaces of the upper end;

the elastomeric means supporting the upper end within the second socket means to permit marginal pivoting of the third member relative to the second socket means, normal to the second axis, lying in a plane parallel to the axis of the arm and passing through the passageway, the elastomeric means extending longitudionally with respect to the third axis confined against relative movement between external surfaces whereby pivoting of the third member from the neutral position relative to the second member about the third axis compresses segments of the elastomeric members therebetween in a direction transverse to their longitudinally thereby resisting pivoting and biasing a return toward the neutral position.

In a third aspect the present invention provides a traffic signal hanger in accordance with the second aspect wherein marginal pivoting of the third member relative to the second member about axes normal to the third axis from the neutral position compresses the elastomeric means therebetween resisting pivoting and biasing a return toward the neutral position.

BRIEF DESCRIPTION OF THE DRAWING

Further aspects and advantages will occur from the following description taken together with the accompanying drawings in which.

DESCRIPTION OF THE PREFERRED EMBODIMENTS

Figure 1:
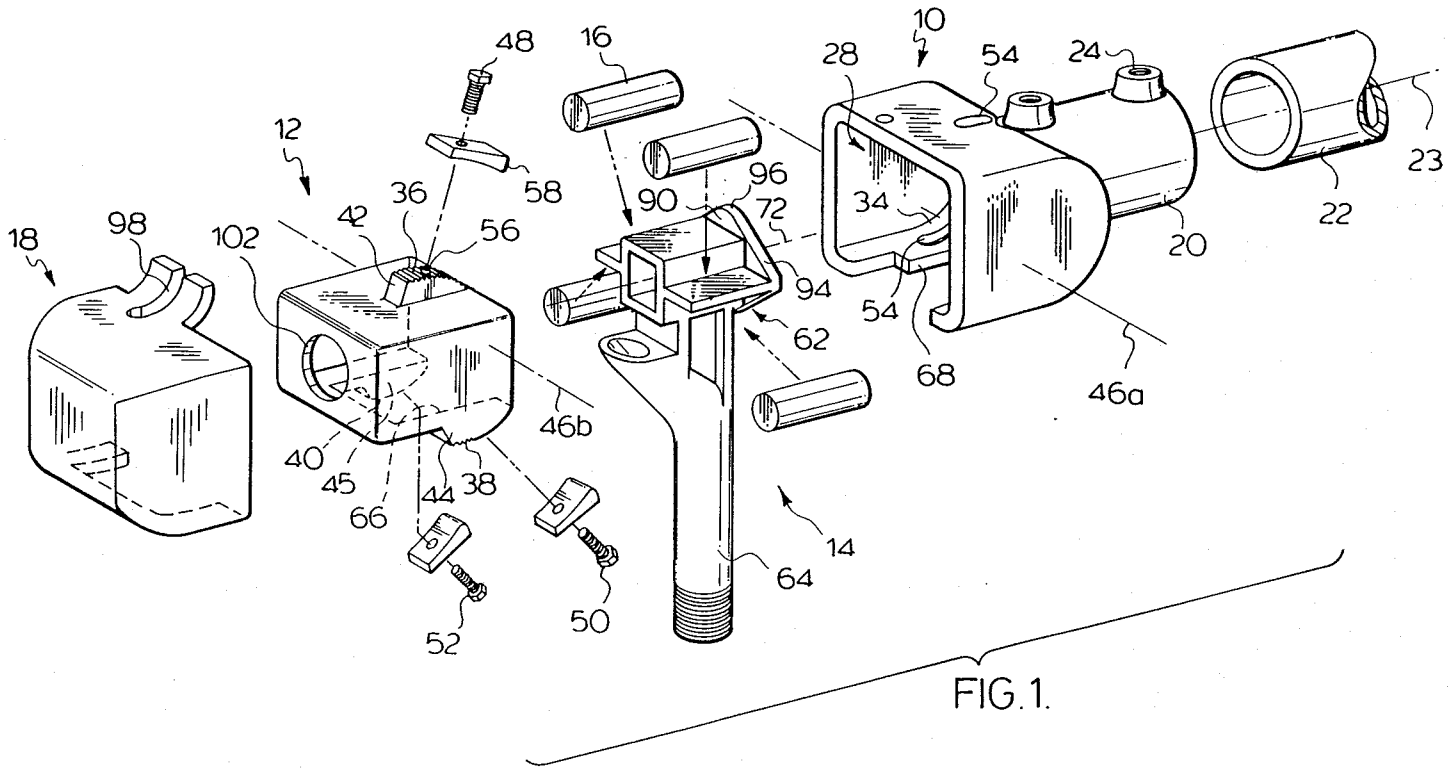
FIG. 1 is an exploded view showing a first embodiment of a traffic signal hanger in accordance with the present invention.

Reference is made first to FIG. 1 which shows in an exploded view the preferred first embodiment of the traffic signal hanger the present invention.

The hanger comprises principally a first member 10, a second member 12, a third member 14, elastomeric rods 16 and end cover 18.

First member 10 has at one end a cylindrical tubular portion 20 adapted to slide over the end of a traffic signal standard arm, partially shown as 22. With tubular portion 20 about arm 22, first member 10 may be rotated with respect to the arm about a first axis 23 coaxially through the arm. Tubular portion 20 carries two threaded holes 24 adapted to receive first set bolts, one of which is shown as 26 in FIG. 2 so as to lock first member 10 in a desired rotational position on arm 22.

Figure 2:
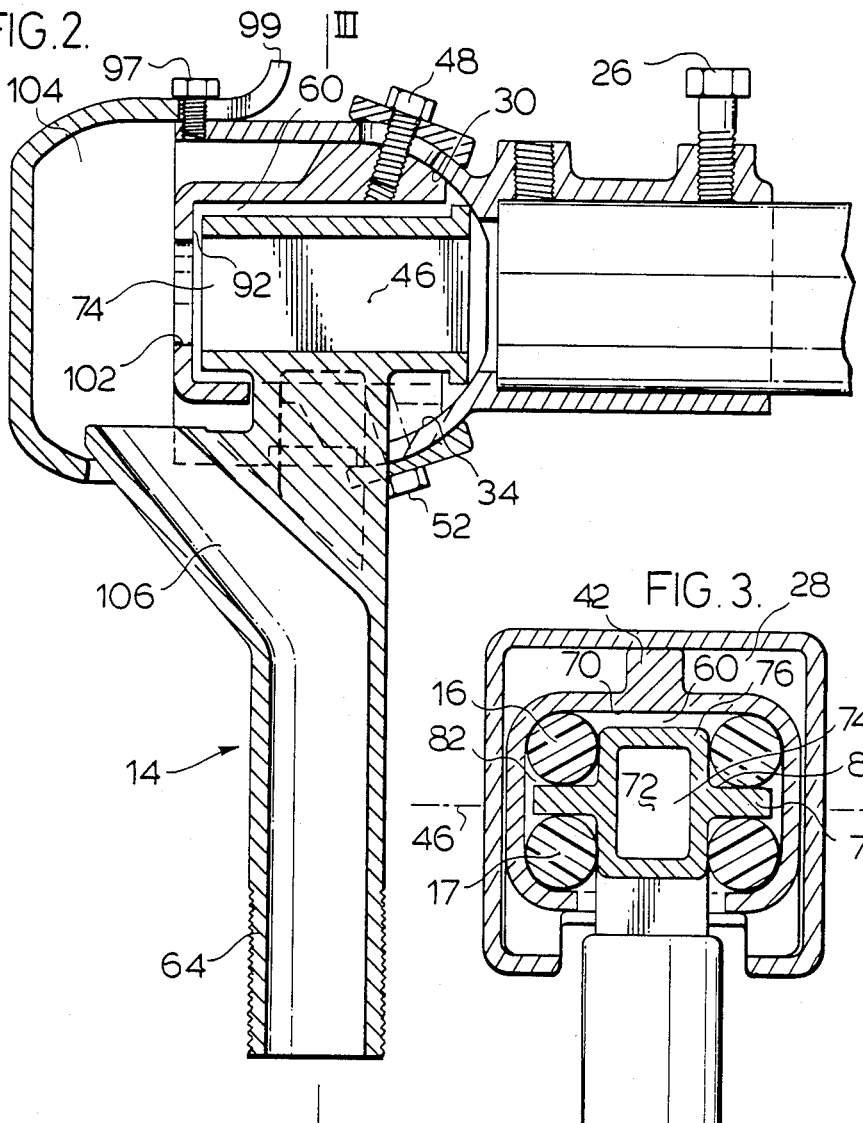
FIG. 2 is a cross-sectional side view of the hanger of FIG. 1 assembled.

The other end of first member 10 carries a first socket generally indicated as 28 adapted to receive second member 12 therein in a ball-in-socket type arrangement. In this regard the inner surfaces of the first socket include contact surface areas 30, 32 and 34 adapted to complementarily abut outer contact surface areas 36, 38 and 40, respectively, defined on projections 42, 44 and 46, on second member 12. These contact surface areas 30, 32 34, 36, 38 and 40 are all formed as portions of a cylindrical surface centered on a second axis 46. Axis 46 is best shown in FIG. 2. In exploded FIG. 1, axis 46 is shown as two axis **46*a* and 46*b* which become superimposed on assembly. Second axis 46 is normal to first axis 23. Small serrations parallel to axis 46 are provided in surfaces 36, 38 and 40 to assist frictional engagement between abutting contact surface areas. Due to the complimentary configuration of the contact surface areas, second member 12 can be moved to varying angular positions about second axis 46. Second member 12 thus effectively is pivotable within first socket 28 about second axis 46 with respect to first member 10**.

Second set bolts 48, 50 and 52 extend through respective elongate aperatures generally indicated 54 in first member 10 into respective threaded holes generally indicated 56 in projections 42, 44 and 45 serving to lock second member 12 in desired positions in first socket 28. Preferrably each second set bolt carries an elongate washer 58.

A second socket or cavity 60 is defined inside of second member 12. An upper end 62 of third member 14 is adapted to be received in cavity 60 together with rods 16 to couple third member 14 to second member 12 and thereby to the remainder of the hanger. In an assembled hanger, upper end 62 of third member 14 is received inside cavity 60 of second member 12 with second member 12 received inside first socket 28 of first member 10. Third member 14 extends downwardly from its upper end 62 to a cylindrical lower end 64 threaded to be adapted for coupling to the traffic signal housing 8 skematically shown in FIG. 4. Third member 14 extends down through a lower opening 66 of cavity 60 and an aligned lower opening 68 of first socket 28.

Figure 3:
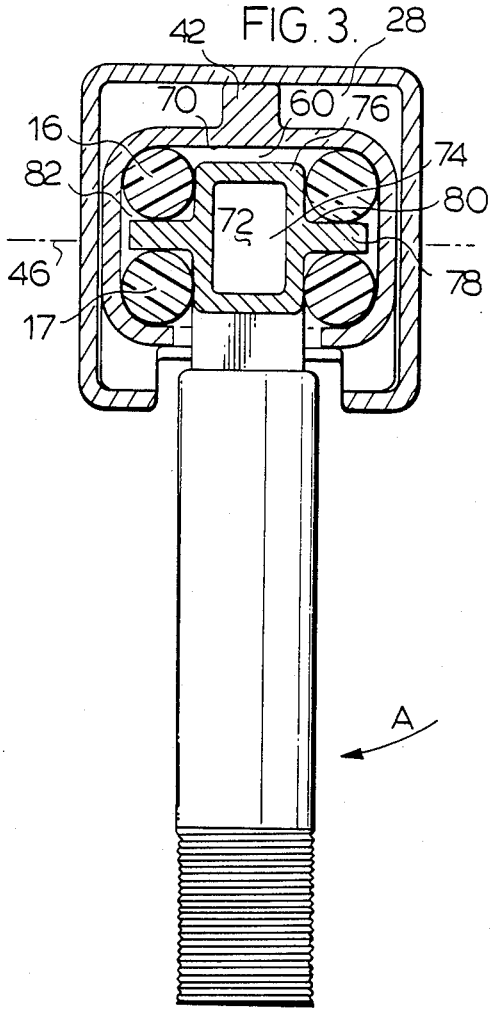
FIG. 3 is a part-sectional side view of the hanger of FIG. 1 through sectional line III—III[1] of FIG. 2.

As best seen in end view as in FIG. 3, the interior surfaces 70 of cavity 60 are parallel with respect to a third axis 72, seen as point in FIG. 3. Interior surfaces 70 provide, in end view an approximately polygonal shape, namely rectangular with four apex or corners.

Upper end 62 of third member 14 has a passage forming bore 74 extending therethrough about third axis 72. Wall 76 appearing rectangular in end cross-section surrounds and defines bore 74. Two flange members 78 extend radially outwardly from third axis 72 and longitudinally, parallel with axis 72 along the outside of wall 76. External surfaces 80 on wall 76 and flange members 78 are parallel to axis 72.

Elongate rods 16 are disposed between the external surfaces 80 of wall 76 and flange members 78 and the internal surfaces 70 of cavity 60. Rods 16 comprise cylindrical members about their individual axes indicated 17, with each rod extending longitudionally of axis 72 parallel thereto. Each rod 16 comprises a resiliently deformable elastomeric material such as rubber. Rods 16 preferrably support upper end 62 of third portion 16 within cavity 60 with external surfaces 80 of the wall and flange members spaced, radially with respect to axis 72 inwardly from interior surfaces 70 of cavity 60. Rods 16,,internal surfaces 70 and external surfaces 80 interact in a manner to permit marginal pivoting of third member 16 with respect to second member 16 about axis 72. For example, on the application of a side force as indicated by arrow A in FIG. 3 in a directional tangential to an arc about axis 72, third member 14 will pivot about axis 72 with respect to second member 12, with rods 16 becoming compressed between exterior surfaces 80 of the wall and flange members and interior surface 70 of cavity 60. Such pivoting will be resisted by the resilient compression of rods 16 in a direction normal to their longitudinal with the compressed rods to bias and urge third member 16 to return to a neutral, equilibrium position as shown in FIG. 3. Rods 16 permit pivoting yet resist pivoting and will dampen any relative pivoting motion.

Each rod 16 is captured within a compartment indicated 82, formed between the apex of the rectangular shape defined by internal surfaces 70, the top or bottom segment of the external surface 80 of a flange member and a vertical segment of the external surface 80 of wall 76. These compartments 82 are configured so that rods 16 are constrained in the apex against movement therefrom on relative rotation of the second and third members about axis 72.

Rods 16 are preferrably received in a force fit relation in the neutral position as seen in FIG. 3 so as to retain the third member in a desired position. Rods 16 are preferrably sufficiently stiff and resistant to deformation that under normal forces to be experienced as by wind forces acting on the hanger, upper end 62 may not be rotated about axis 72 so far as to have external surfaces 80 contact internal surfaces 70.

Upper end 62 carries about the end of bore 74 nearest first member 10 a reinforcing, flange-like stop plate 90 extending from bore 74 outwardly in a plane normal to axis 72. In an assembled hanger, stop plate 90 serves to retain rods 16 against movement longitudinally to their axis. Rods are restrained at one end by stop plate 90 and at the other end by end wall 92 of cavity 60. Stop plate 90 has an outer edge 94 sloping from curved, top and bottom center portions 96 diagionally to the flange members. These center portions 96 may preferrably engage inner surfaces of first socket 28 as seen in FIG. 2, and assist in retaining upper end 62 between first member 10 and second member 12 and assist in providing a pivot point about which the third member may pivot.

Third axis 72 is normal to axis 46 and lies in a plane which is parallel to axis 23. Preferably, as shown, axis 72 and axis 23 lie in the same central plane with both axis 72 and axis 46 horizontal to orientate lower end 64 of third member 14 vertical.

End cover 18 is removably secured to first member 10 by bolt 97 passing through slot 98 bordered by curved prongs 99. Prongs 99 provide for easy coupling of end cover 18 prior to tightening of bolt 97. As seen in FIG. 2, in an assembled hanger, a continuous passageway is provided internally from arm 22 to out of the lower end 64 of third member 14. In this regard, the hollow interior of arm 22 opens into a hollow cylindrical interior of tubular portion 20, which in turn opens into first socket 28. Bore 74 opens towards the interior of tubular portion 20 and provides communication into cavity 60. An aligned opening 102 in end wall 92 of cavity 60 provides communication from bore 74 into a space 104 within end rover 18.

Space 104 communicates with a passageway 106 formed within third member 14, extending first diagionally downward to below upper end 62 then vertically downward coaxially inside cylindrical lower end 64.

In use of the hanger, electrical wire from a hanger coupled to lower end 64 may pass upward through passageway 106 to space 104. Electrical wire from standard arm 22 may pass through the first member, second member and upper end, principally via bore 74 into space 104. Removable end cover 18 provides easy access to wires in space 104 for installation.

Figure 4:
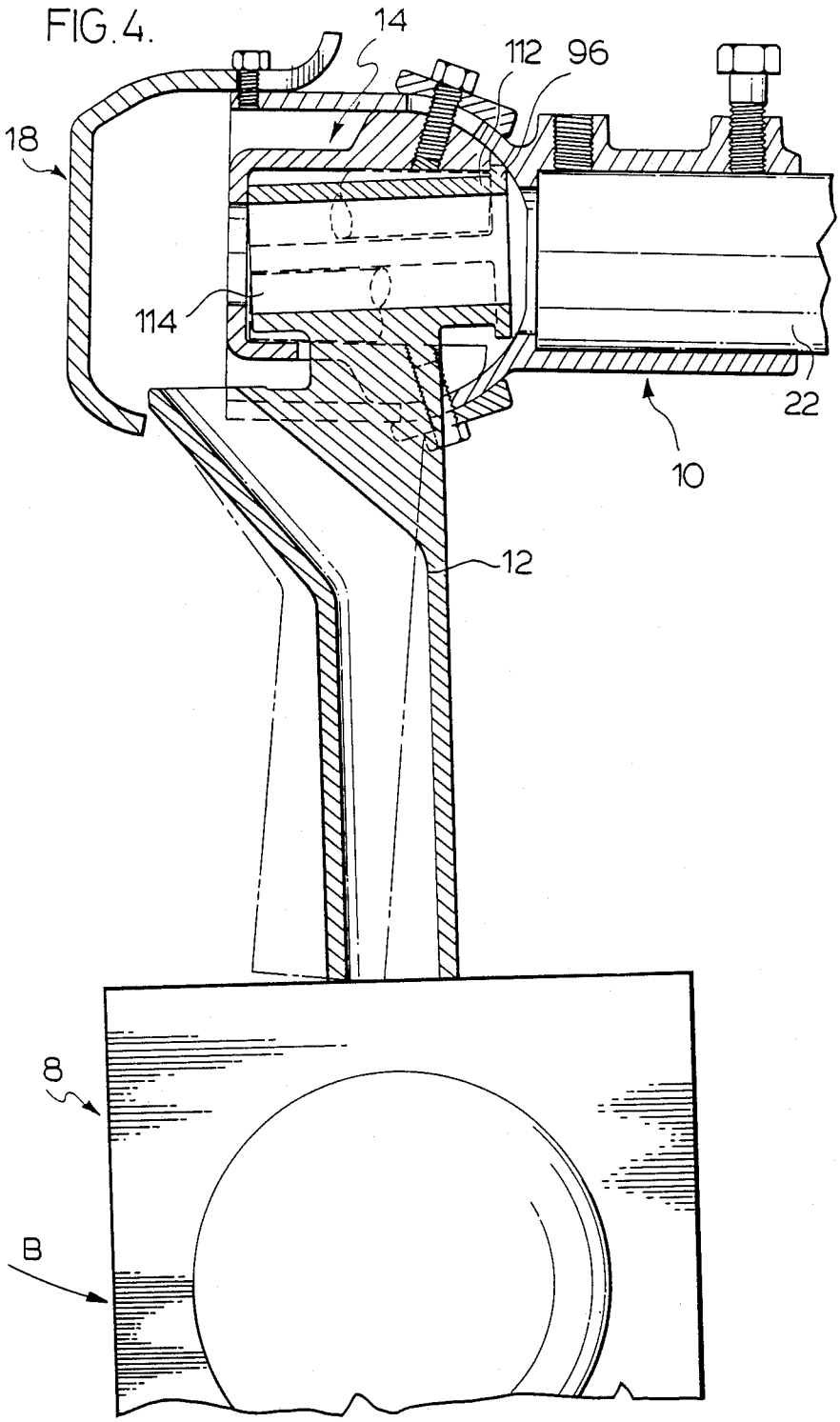
FIG. 4 is a cross-sectional view similar to FIG. 2 but showing the hanger in displaced and stressed positions.

Rods 16 have been described above to locate upper end 62 in cavity 60 and to permit marginal pivoting of upper end 62 about axis 72 with respect to second member 12. Preferrably, in addition, rods 16 provide for advantageous pivoting of upper end 62 about axes other than axis 72 relative to the second member. For example, as seen in FIG. 4, an end force represented by arrow B in FIG. 4 is shown urging lower end 64 of third member 14 to the right. This action tends to pivot third member 14 about an axis parallel to the axis 46, moving the third member from a neutral position shown in dotted lines to a compressed position shown in solid lines. As seen in solid lines, upper rods 16 are compressed as at 112 at one end and lower rods 16 are compressed as at 114 at another end. Third member 14 can, for example, rotate about an axis parallel to axis 46 about a pivot point where top center portion 96 may engage first member 10. Resilient compression of rods 16 will resist pivoting and bias third member 14 to return to a neutral position with resultant dampening of any resultant oscillatory motion. Similarly it is to be appreciated that forces tending to pivot the third member relative to the second member in a great many different directions will be resisted and permitted by compression of rods 16. Pivoting may occur about axis 72, about axes parallel to or normal to axis 72 and at angles thereto.

In use of an assembled hanger in accordance with the present invention, the first member 10 is attached to arm 22 and rotated about axis 23 until lower arm 64 hangs vertically down as seen in side view. Next, second member 12 is rotated about axis 46 with respect to first member 10 to locate lower end 64 hanging vertically downward as seen in side view. With the hanger locked in this position axis 72 is preferably horizontal. Axis 72 may be at an angle with respect to axis 23 of arm 22 as seen in FIG. 4.

Rods 16 preferably comprise elastomeric material such as rubber and synthetic polymers with rubber like properties. Black natural rubber of 70 durometer hardness is preferred. Such natural rubber has excellent resistance to mechanical abrasion, low cost and ability to maintain resiliency at low temperatures.

The first member 10, second member 12, third member 14 and end cover 18 may be made from metal as by casting.

In assembly of the hanger, the fact that rods 16 need not be substantially pre-compressed before insertion into their compartments 82 assists assembly, as contrasted with metal springs which typically require prestressing.

Figure 6:
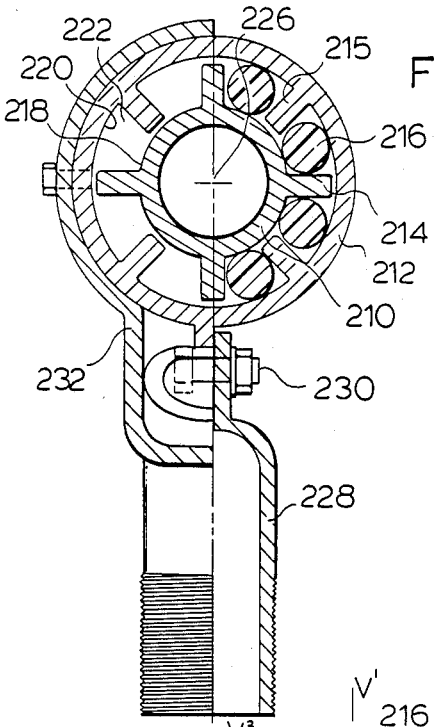
FIGS. 5 and 6 are cross-sectional side and end views of a second embodiment of a hanger in accordance with the present invention.
Figure 5:
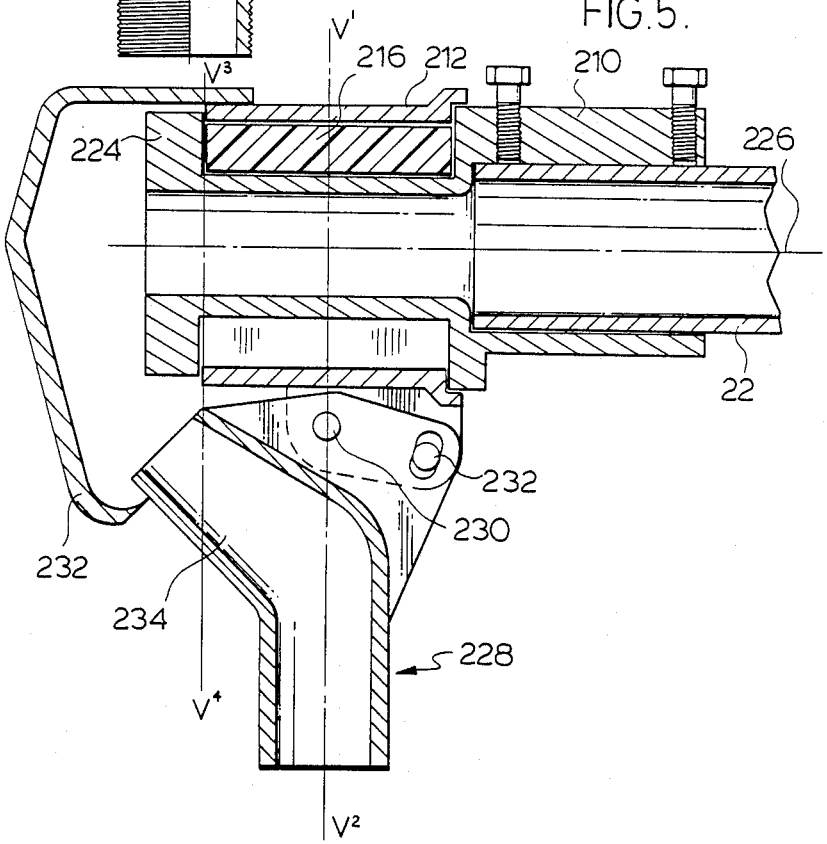

Reference is now made to FIGS. 5 and 6 showing a second embodiment of the present invention. FIG. 5 is a side cross-section and FIG. 6 is a split end cross-section along lines $V^1$—$V^2$ and $V^3$—$V^4$ in FIG. 5. In the second embodiment hub member 210 is coaxially received about support arm 22. Coaxially about hub member 210 is encircling member 212. Each of hub member 210 and encircling member 212 have radially extending flanges 214 and 215, respectively. Rods 216 of elastomeric material are disposed between external surfaces 218 of hub member 210 and internal surfaces 220 of encircling member 212 captured in compartments 222 between adjacent flanges. Hub member 210 has an end plug 224 retaining encircling member 212 and rods 216 on hub member 210. Encircling member 212 is rotatable on hub member 210 about coaxial axis 226 and to a minor extent about axes normal to axis 226. Bracket member 228 is hingedly coupled to encircling member 212 for pivoting about bolt 230. Locking bolt 232 serves to lock bracket member 228 at desired angular positions to encircling member 212. .Bracket member 228 is threaded at its lower end to receive a signal housing. Vertical orientation of the signal housing is permitted by suitably locking hub member 210 at desired rotation position on arm 22 about axis 226 and suitably locking bracket member 228 at desired angular orientation about the axis of bolt 230.

An internal passageway is provided through arm 22 and hub member 210 to inside of removable end cover 232 then down internally through bent passageway 234 in bracket member 228.

Figure 8:
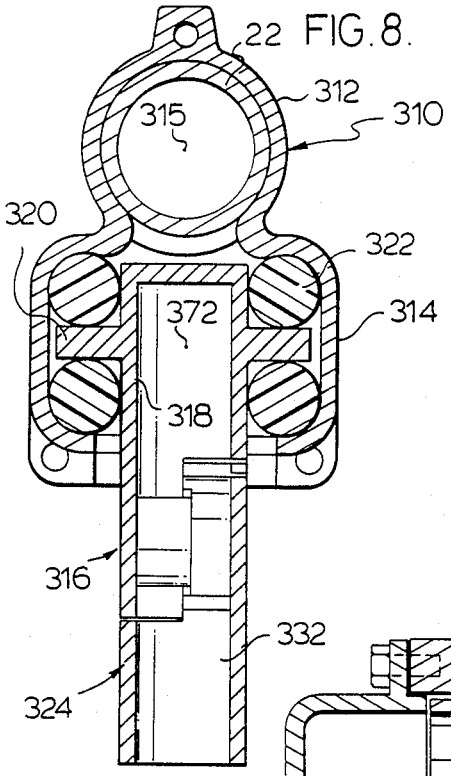
FIGS. 7 and 8 are cross-sectional side and end views of a third embodiment of a hanger in accordance with the present invention.
Figure 7:
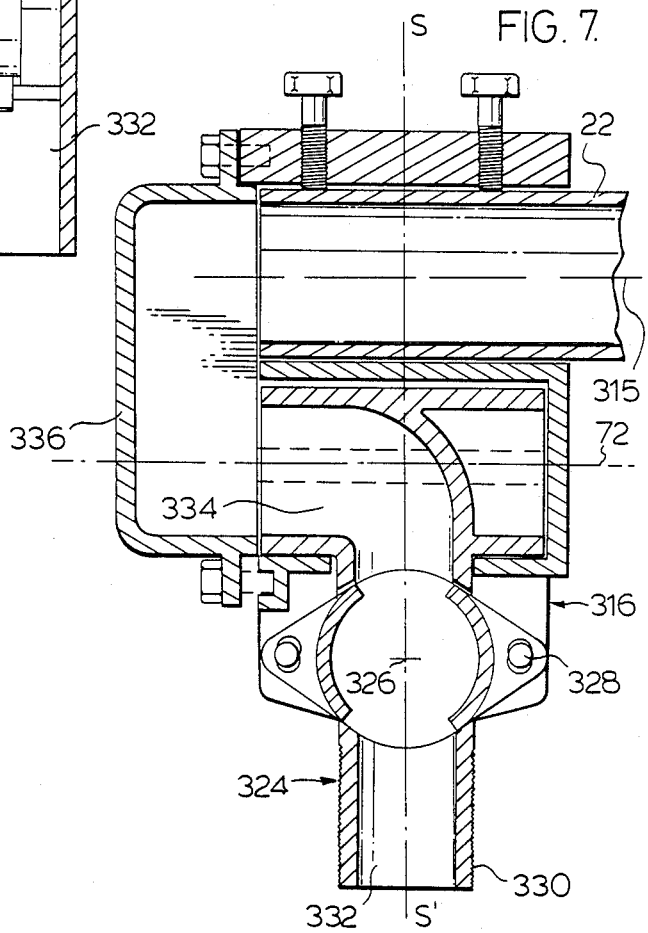

Reference is now made to FIGS. 7 and 8 showing a third embodiment of the present invention. FIG. 7 is a side cross-sectional view and FIG. 8 is an end cross-sectional view along section lines S—$S^1$ in FIG. 7.

The third embodiment has an outer casing 310 forming an upper cylindrical portion 312 coaxially received about standard arm 22. Casing 310 also forms a lower cavity 314 with internal surfaces, in end view parallel to axis 315 of arm 22. Disposed in cavity 314 is the upper end of intermediate member 316 having a wall 318 and flanges 320 similar to that of the upper end 66 of the third member 14 in the first embodiment shown in FIGS. 1 to 4. The upper end of the intermediate member 316 is pivotably mounted in cavity 314 via elastomeric rods 322 to pivot about axis 72 similar to the mounting of upper end 62 of third member 14 in cavity 60 with rods 16 in the first embodiment.

Bracket member 324 is mounted to the lower end of the intermediate member 315, and lockable at a desired position by bolts to be received in holes 328. Bracket member has a lower cylindrical end 330 to which a signal housing is to be mounted.

A passageway 332 extends internally up bracket member 324 into a passageway 334 extending inside intermediate member 316 and opening to the inside of a removable cap 336. The inside of cap 336 is in communication with the inside of arm 22.

In use of the third embodiment adjustment of casing 310 about the axis 315 of arm 22 and adjustment of bracket 324 about axis 326 permit for hanging a signal housing vertically.

While the invention has been described with reference to preferred embodiments, the invention is not so limited. Many variations and modification so will now occur to those skilled in the art. For a definition of the invention reference is made to the appended claims.

What I claim is:

1. A traffic signal hanger comprising:

first means fixedly coupled to a support arm, second means fixedly coupled to a traffic signal housing, joint means coupling the first means and second means together for marginal pivoting of the second means with respect to the first means about a first axis, said joint means comprising:

(a) a cavity about the axis defined by internal surfaces of one of the first and second means;

(b) an end portion on the other of the first and second means extending into the cavity, the end portion having a passageway-forming bore therethrough; and (c) resiliently-deformable, elongate rods of elastomeric material in the cavity between external surfaces of the end portion and said internal surfaces, the rods extending longitudinally with respect to the axis, between the internal surfaces and the external surfaces, supporting the end portion in the cavity with the first axis passing through said bore and spacing the end portion radially with respect to the first axis from the internal surfaces, said end portion having a wall surrounding said bore and flange members extending radially outwardly from the wall with respect to the first axis longitudinally with respect to the first axis, said rods located adjacent the flange members whereby pivoting of the end portion and said one of the first and second means relative to each other about the first axis from a neutral position compresses the rods between the flange members and the internal surfaces resisting pivoting and biasing a return toward the neutral position.

2. A traffic signal hanger as claimed in claim 1 wherein marginal pivoting of said end portion and said one of the first and second means relative to each other about a second axis normal to said first axis from said neutral position compresses the rods therebetween resisting pivoting and biasing a return toward said neutral position.

3. A traffic signal hanger as claimed in claim 1 wherein a plurality of longitudinally extending compartments are defined between the external surfaces of the end portion, the flange members and the internal surfaces within which said rods are received, said compartments and rods sized to preclude movement of the rods received therein one of the compartments.

4. A traffic signal hanger as claimed in claim 3 wherein said rods are force fitted into said compartments.

5. A traffic signal hanger as claimed in claim 1 including openings through said one of said first and second means into the cavity, about the axis, and in communication with the bore to provide via the bore a continuous passageway for wire through said joint.

6. A traffic signal housing as claimed in claim 5 wherein said first means includes positioning means to locate said first axis horizontal.

7. A traffic signal hanger comprising:

a first member carrying, at a first end, arm mounting means for mounting on a support arm rotatable about the axis of the arm with first lock means to lock the first member in a desired position on the arm with respect to the axis of the arm, first socket means defined within said first member at a second end thereof, a second member received in the first socket means rotatable therein about a second is normal to the axis of the arm with second lock means to lock the second member in a desired position in the first socket means with respect to the second axis, second socket means defined within the second member by interior surfaces thereof, a third member having an upper end received in the second socket means, the third member extending from the upper end out of the second socket means to a lower end carrying means for mounting a traffic signal housing, the upper end having a passageway therethrough, elastomeric means in the second socket means between external surfaces on the upper end and said interior surfaces, the elastomeric means supporting the upper end within the second socket means to permit marginal pivoting of the third member relative to the second member about a third axis through the second socket means, normal to the second axis, lying in a plane parallel to the axis of the arm and passing through said passageway, the elastomeric means extending longitudinally with respect to the third axis confined against relative movement between external surfaces of the end portion and said interior surfaces whereby pivoting relative to the third member from a neutral position relative to the second member about said third axis compresses segments of the elastomeric members therebetween in a direction transverse to their longitudinal thereby resisting pivoting and biasing a return toward the neutral position.

8. A traffic signal hanger as claimed in claim 7 wherein marginal pivoting of said third member relative to the second member about axes normal to the third axis from said neutral position compresses the elastomeric means therebetween resisting pivoting and biasing a return toward said neutral position.

9. A traffic signal hanger as claimed in claim 7 wherein said second member has outer surfaces of cylindrical shape complimentary to cylindrical inner surfaces in the first socket means to be slidably engaged thereby in a ball-in-socket type arrangement.

10. A traffic signal hanger as claimed in claim 9 wherein interior surfaces of the second member contacted by said elastomeric means are parallel to said third axis.

11. A traffic signal hanger as claimed in claim 10 wherein said second socket means has a cross-sectional shape normal to the second axis which is substantially polygonal, said elastomeric means comprising elongate rods of elastomeric material confined against movement relative to said second socket means within apexes of said polygonal cross-sectional shape.

12. A traffic signal hanger as claimed in claim 11 wherein said end portion has, in cross-sectional normal to the third axis, external surfaces of alternating increasing and decreasing distances from the third axis defining therebetween opposite said apexes of the polygonal cross-sectional shape and in co-operation with said apexes, compartments within which said rods are confined in force fit relation against removal.

* * * * *